US008935081B2

(12) United States Patent
Jackson et al.

(10) Patent No.: US 8,935,081 B2
(45) Date of Patent: Jan. 13, 2015

(54) FUEL SYSTEM BLOCKAGE DETECTION AND BLOCKAGE LOCATION IDENTIFICATION SYSTEMS AND METHODS

(75) Inventors: Robert Jackson, Brighton, MI (US); William R. Cadman, Fenton, MI (US); David Edward Prout, Linden, MI (US)

(73) Assignee: GM Global Technology Operations LLC

( * ) Notice: Subject to any disclaimer, the term of this patent is extended or adjusted under 35 U.S.C. 154(b) by 421 days.

(21) Appl. No.: 13/350,141

(22) Filed: Jan. 13, 2012

(65) Prior Publication Data

US 2013/0184963 A1 Jul. 18, 2013

(51) Int. Cl.
*F02D 41/22* (2006.01)

(52) U.S. Cl.
USPC ..... 701/114; 123/198 D; 73/114.41

(58) Field of Classification Search
CPC . F02D 41/0002; F02D 29/02; F02D 41/0025; F02D 41/22; F02D 41/401; F02D 41/3836; F01M 11/10
USPC ..... 701/101, 102, 105–107, 114; 123/516, 123/518, 520, 196 S, 198 D; 73/40.7, 73/114.18, 114.38, 114.39, 114.41, 73/114.43, 114.52, 114.54
See application file for complete search history.

(56) References Cited

U.S. PATENT DOCUMENTS 4,751,501 A 6/1988 Gut
5,150,689 A * 9/1992 Yano et al. ..... 123/519
5,158,054 A * 10/1992 Otsuka ..... 123/198 D
5,317,909 A * 6/1994 Yamada et al. ..... 73/114.39
5,606,311 A 2/1997 Polidan et al.
5,616,157 A 4/1997 Mead et al.
5,750,888 A 5/1998 Matsumoto et al.
5,895,859 A 4/1999 Sawada et al.
6,016,690 A 1/2000 Cook et al.
6,047,692 A * 4/2000 Toyoda ..... 123/698
6,164,123 A 12/2000 Corkill
RE37,250 E * 7/2001 Kayanuma ..... 123/198 D
6,311,548 B1 11/2001 Breidenbach et al.
6,363,921 B1 4/2002 Cook et al.
6,467,463 B2 10/2002 Kitamura et al.

(Continued)

FOREIGN PATENT DOCUMENTS

DE 4321694 A1 1/1995
DE 19502776 C1 6/1996

(Continued)

OTHER PUBLICATIONS

U.S. Appl. No. 13/651,533, filed Oct. 15, 2012, Jackson et al.

(Continued)

*Primary Examiner* — John Kwon
*Assistant Examiner* — Johnny H Hoang

(57) ABSTRACT

A system for a vehicle includes a first pressure module and a blockage indication module. The first pressure module receives a signal from a pressure sensor that measures pressure within a fuel vapor purge system. The first pressure module generates a first pressure based on the signal at a first time and generates a second pressure based on the signal at a second time. The second time is after the first time. The blockage indication module indicates whether a blockage is present in the fuel vapor purge system between the pressure sensor and a fuel tank based on a difference between the first and second pressures.

24 Claims, 3 Drawing Sheets

(56) References Cited

U.S. PATENT DOCUMENTS

| | | | | |
|---|---|---|---|---|
| 6,508,235 | B2 * | 1/2003 | Fabre | 123/520 |
| 6,526,760 | B2 | 3/2003 | Fickel et al. | |
| 6,536,261 | B1 | 3/2003 | Weldon et al. | |
| 6,761,154 | B2 | 7/2004 | Takagi et al. | |
| 6,874,523 | B2 | 4/2005 | Yoshihara et al. | |
| 6,970,775 | B2 | 11/2005 | Lederle et al. | |
| 6,988,396 | B2 | 1/2006 | Matsubara et al. | |
| 7,066,152 | B2 | 6/2006 | Stroia et al. | |
| 7,107,971 | B2 | 9/2006 | Spink et al. | |
| 7,383,826 | B2 | 6/2008 | Kano et al. | |
| 7,438,060 | B2 | 10/2008 | McLain | |
| 7,441,545 | B1 | 10/2008 | Fisher et al. | |
| 7,444,234 | B2 | 10/2008 | Bauerle | |
| 8,108,127 | B2 * | 1/2012 | Grunwald et al. | 701/107 |
| 8,155,917 | B2 * | 4/2012 | Maegawa | 702/140 |
| 8,327,695 | B2 | 12/2012 | Jackson et al. | |
| 8,353,273 | B2 | 1/2013 | McLain et al. | |
| 8,560,158 | B2 | 10/2013 | Wang et al. | |
| 2001/0027682 | A1 * | 10/2001 | Takagi et al. | 73/118.1 |
| 2001/0032626 | A1 * | 10/2001 | Fabre | 123/520 |
| 2002/0046609 | A1 | 4/2002 | Ito | |
| 2003/0075156 | A1 * | 4/2003 | Morinaga et al. | 123/520 |
| 2003/0183206 | A1 | 10/2003 | Fujimoto et al. | |
| 2003/0226549 | A1 | 12/2003 | Takagi et al. | |
| 2004/0089063 | A1 | 5/2004 | Matsubara et al. | |
| 2005/0240338 | A1 | 10/2005 | Ardisana | |
| 2007/0089721 | A1 | 4/2007 | Amano et al. | |
| 2008/0135025 | A1 | 6/2008 | McLain | |
| 2008/0190177 | A1 | 8/2008 | Wiggins et al. | |
| 2009/0138173 | A1 * | 5/2009 | Liu | 701/103 |
| 2009/0266147 | A1 | 10/2009 | Maegawa | |
| 2009/0299561 | A1 | 12/2009 | Matsumoto | |
| 2011/0011472 | A1 | 1/2011 | McLain et al. | |
| 2011/0123372 | A1 * | 5/2011 | Itoh et al. | 417/410.1 |
| 2012/0097252 | A1 | 4/2012 | McLain et al. | |
| 2013/0184963 | A1 | 7/2013 | Jackson et al. | |

FOREIGN PATENT DOCUMENTS

| | | | |
|---|---|---|---|
| DE | 19630985 | A1 | 3/1997 |
| DE | 19710981 | A1 | 10/1998 |
| DE | 10037939 | | 6/2001 |
| DE | 10245158 | A1 | 4/2003 |

OTHER PUBLICATIONS

U.S. Appl. No. 13/832,766, filed Mar. 15, 2013, Jackson, et al.
U.S. Appl. No. 13/909,424, filed Jun. 4, 2013, Jackson, et al.
Office Action dated Mar. 14, 2012 from German Patent Office for German Patent Application No. 102010026655.8; 7 Pages.

* cited by examiner

FUEL SYSTEM BLOCKAGE DETECTION AND BLOCKAGE LOCATION IDENTIFICATION SYSTEMS AND METHODS

FIELD

The present disclosure generally relates to internal combustion engines and more particularly to systems and methods for identifying blockages in fuel systems.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust a mixture of air and fuel to generate torque. The fuel may be a combination of liquid fuel and vapor fuel. A fuel system supplies liquid fuel and vapor fuel to the engine. A fuel injector provides the engine with liquid fuel drawn from a fuel tank. A vapor purge system provides the engine with fuel vapor drawn from a vapor canister.

Liquid fuel is stored within the fuel tank. In some circumstances, the liquid fuel may vaporize and form fuel vapor. The vapor canister traps and stores the fuel vapor. The purge system includes a purge valve. Operation of the engine causes a vacuum (low pressure relative to atmospheric pressure) to form within an intake manifold of the engine. The vacuum within the intake manifold and selective actuation of the purge valve allows the fuel vapor to be drawn into the intake manifold and purge the fuel vapor from the vapor canister.

SUMMARY

A system for a vehicle includes a first pressure module and a blockage indication module. The first pressure module receives a signal from a pressure sensor that measures pressure within a fuel vapor purge system. The first pressure module generates a first pressure based on the signal at a first time and generates a second pressure based on the signal at a second time. The second time is after the first time. The blockage indication module indicates whether a blockage is present in the fuel vapor purge system between the pressure sensor and a fuel tank based on a difference between the first and second pressures.

A method for a vehicle includes: receiving a signal from a pressure sensor that measures pressure within a fuel vapor purge system; generating a first pressure based on the signal at a first time; and generating a second pressure based on the signal at a second time. The second time is after the first time. The method further includes indicating whether a blockage is present in the fuel vapor purge system between the pressure sensor and a fuel tank based on a difference between the first and second pressures.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

A fuel system includes a vapor canister that traps and stores fuel vapor. A purge valve is selectively opened to purge the fuel vapor from the vapor canister to an internal combustion engine. When the purge valve is open, vacuum within an intake manifold of the engine draws the fuel vapor from the vapor canister through the purge valve. Fresh air flows toward the vapor canister as fuel vapor is purged from the vapor canister.

A control module selectively closes the purge valve and activates a vacuum pump for a predetermined period to determine whether a blockage is present. Closing the purge valve seals the fuel system, and the vacuum pump pumps gasses out of the fuel system. A second pressure sensor measures pressure near the vacuum pump. The control module selectively determines whether a blockage is present between the vacuum pump (or the second pressure sensor) and a fuel tank. The control module determines whether a blockage is present based on a change in the pressure measured using the second pressure sensor over the predetermined period. When a blockage is present, the control module determines whether the blockage is located between the vacuum pump/the second pressure sensor and a first pressure sensor or between the first pressure sensor and the fuel tank. Based on the location of the blockage, the vehicle can be appropriately serviced to alleviate the blockage.

Figure 1:
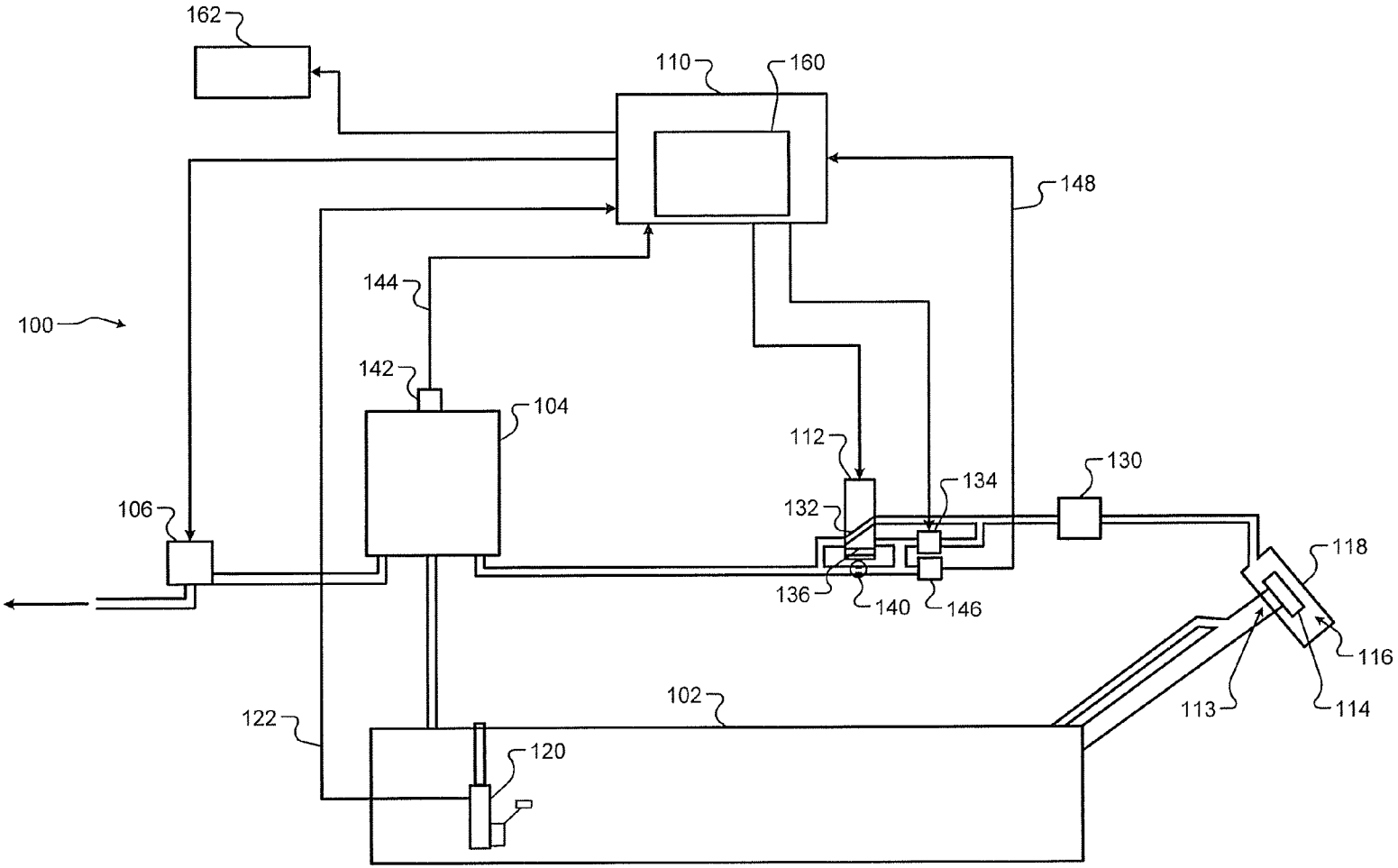
FIG. 1 is a functional block diagram of an example fuel system and a control system according to the present disclosure.

Referring now to FIG. 1, a functional block diagram of an example fuel system 100 and a control system for the fuel system 100 is presented. A vehicle includes an internal combustion engine (not shown) that generates drive torque. Hybrid vehicles, including plug-in hybrid vehicles, may include one or more electric motors and/or motor generators in addition to the engine. The engine combusts a mixture of air and fuel within one or more cylinders of the engine to generate torque. The engine may be a gasoline engine, a diesel engine, or another suitable type of internal combustion engine.

The fuel system 100 supplies fuel to the engine. More specifically, the fuel system 100 supplies liquid fuel and fuel vapor to the engine. The fuel system 100 includes a fuel tank 102 that contains liquid fuel. Liquid fuel is drawn from the fuel tank 102 and supplied to the engine by one or more fuel pumps (not shown).

Some conditions, such as heat, vibration, and/or radiation, may cause liquid fuel within the fuel tank 102 to vaporize. A vapor canister 104 traps and stores vaporized fuel (fuel vapor). The vapor canister 104 may include one or more substances that trap and store fuel vapor, such as a charcoal.

Operation of the engine creates a vacuum within an intake manifold (not shown) of the engine. A purge valve 106 may be selectively opened to draw fuel vapor from the vapor canister 104 to the intake manifold for combustion. A control module (CM) 110, such as an engine control module (ECM), controls the purge valve 106 to control the flow of fuel vapor to the engine.

The CM 110 also controls a switching valve 112. When the switching valve 112 is in a vent position, the CM 110 may selectively open the purge valve 106 to purge fuel vapor from the vapor canister 104 to the intake manifold. The CM 110 may control the rate at which fuel vapor is purged from the vapor canister 104 (a purge rate) by controlling opening and closing of the purge valve 106. For example only, the purge valve 106 may include a solenoid valve, and the CM 110 may control the purge rate by controlling duty cycle of a signal applied to the purge valve 106.

The vacuum within the intake manifold draws fuel vapor from the vapor canister 104 through the purge valve 106 to the intake manifold. The purge rate may be determined based on the duty cycle of the signal applied to the purge valve 106 and the amount of fuel vapor within the vapor canister 104. Ambient air is drawn into the vapor canister 104 through the switching valve 112 as fuel vapor is drawn from the vapor canister 104.

The CM 110 actuates the switching valve 112 to the vent position and controls the duty cycle of the purge valve 106 while the engine is running. When the engine not running (e.g., key OFF), the CM 110 actuates the purge valve 106 to the closed position. In this manner, the purge valve 106 is maintained in the closed position when the engine is not running.

A driver of the vehicle may add liquid fuel to the fuel tank 102 via a fuel inlet 113. A fuel cap 114 seals the fuel inlet 113. The fuel cap 114 and the fuel inlet 113 may be accessed via a fueling compartment 116. A fuel door 118 may be implemented to shield and close the fueling compartment 116.

A fuel level sensor 120 measures an amount of liquid fuel within the fuel tank 102. The fuel level sensor 120 generates a fuel level signal 122 based on the amount of liquid fuel within the fuel tank 102. For example only, the amount of liquid fuel in the fuel tank 102 may be expressed as a volume, a percentage of a maximum volume of the fuel tank 102, or another suitable measure of the amount of fuel in the fuel tank 102.

The ambient air provided to the vapor canister 104 through the switching valve 112 may be drawn from the fueling compartment 116. A filter 130 receives the ambient air and filters various particulate from the ambient air. For example only, the filter 130 may filter particulate having a dimension of greater than a predetermined dimension, such as approximately 5 microns.

The switching valve 112 may be actuated to the vent position or to a pump position. The switching valve 112 is shown as being in the vent position in the example of FIG. 1. When the switching valve 112 is in the vent position, air can flow from the filter 130 to the vapor canister 104 via a first path 132 through the switching valve 112. When the switching valve 112 is in the pump position, air can flow between a vacuum pump 134 and the vapor canister 104 via a second path 136 through the switching valve 112.

When the vacuum pump 134 is activated while the switching valve 112 is in the pump position, the vacuum pump 134 may draw gasses (e.g., air) through the switching valve 112 and expel the gasses through the filter 130. The vacuum pump 134 may draw the gasses through the second path 136 and a reference orifice 140. A relief valve (not shown) may be implemented to selectively discharge pressure or vacuum within the fuel system 100.

A first pressure sensor 142 measures a first pressure within the fuel tank 102 and generates a first pressure signal 144 based on the first pressure. For example only, the first pressure sensor 142 may be located at a top of the vapor canister 104. In various implementations, the first pressure sensor 142 may measure vacuum within the fuel tank 102 where the vacuum is measured relative to ambient pressure. The first pressure sensor 142 may also be referred to as a tank pressure sensor.

A second pressure sensor 146 measures a second pressure. The second pressure sensor 146 generates a second pressure signal 148 based on the second pressure. The second pressure measured by the second pressure sensor 146 may be based on whether the switching valve 112 is in the pump position or the vent position. When the switching valve 112 is in the pump position, the pressure measured by the second pressure sensor 146 should be approximately equal to the first pressure. When the switching valve 112 is in the vent position, the pressure measured by the second pressure sensor 146 may approach ambient air pressure.

However, a blockage may occur between the second pressure sensor 146 and the fuel tank 102. The presence of liquid (e.g., fuel) or another non-gaseous substance may cause a blockage. A blockage may also be present when a component is crushed, pinched, or otherwise damaged such that the flow of fuel vapor is blocked.

When a blockage is present, adding fuel to the fuel tank 102 may be difficult as the blockage may impede the ability of liquid fuel to displace gasses within the fuel tank 102. Additionally, purging of fuel vapor may create a vacuum within the fuel tank 102 as the flow of fresh air to the vapor canister may be impeded when a blockage is present.

A blockage detection module 160 detects and indicates whether a blockage is present between the second pressure sensor 146 and the fuel tank 102. When a blockage is present, the blockage detection module 160 determines and indicates whether the blockage is located: (i) between the fuel tank 102 and the first pressure sensor 142; or (ii) between the first pressure sensor 142 and the vacuum pump 134. One or more remedial actions may be taken when a blockage is present, such as setting one or more a predetermined codes (e.g., a diagnostic trouble code(s)) in memory, activating an indicator lamp 162 (e.g., a malfunction indicator lamp or MIL), and/or one or more other suitable remedial actions.

Figure 2:
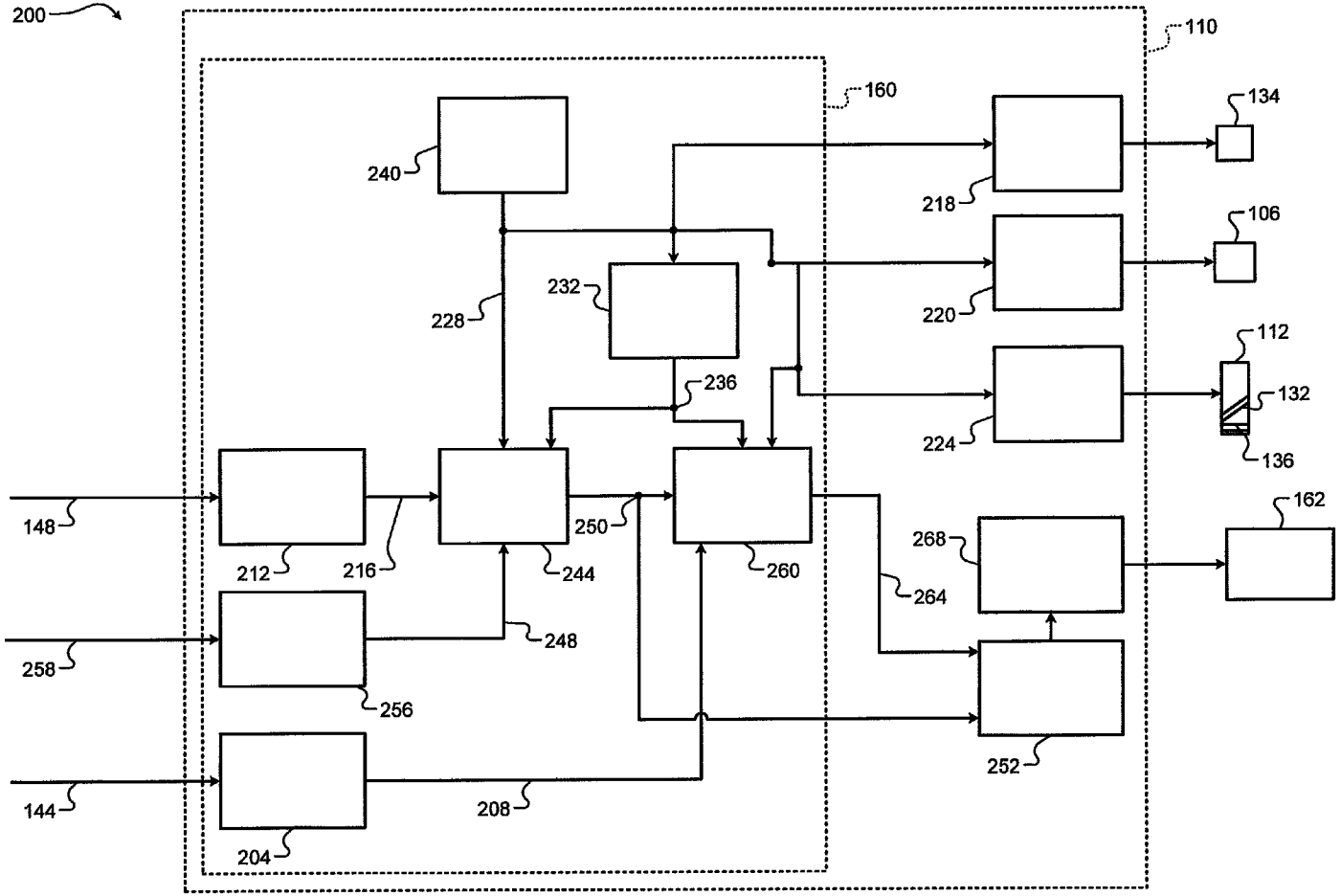
FIG. 2 is a functional block diagram of an example control system according to the present disclosure.

The indicator lamp 162 may, for example, indicate that it may be appropriate to seek servicing for the vehicle. Upon servicing the vehicle, a vehicle service technician may access the memory. The one or more predetermined codes set may serve to indicate to the vehicle service technician that a blockage is present and the location of the blockage Referring now to FIG. 2, a functional block diagram of an example control system 200 is presented. A first pressure module 204 receives the first pressure signal 144 and outputs first pressures 208 based on the first pressure signal 144. The first pressure module 204 may, for example, sample, buffer, digitize, filter, and/or perform one or more other functions to generate the first pressures 208. At least two of the first pressures 208 from at least two times, respectively, are used as discussed further below.

A second pressure module 212 receives the second pressure signal 148 and outputs second pressures 216 based on the second pressure signal 148. The second pressure module 212 may, for example, sample, buffer, digitize, filter, and/or perform one or more other functions to generate the second pressures 216. At least two of the second pressures 216 from at least two times, respectively, are used as discussed further below.

A pump control module 218 controls the vacuum pump 134. A purge valve control module 220 controls opening and closing of the purge valve 106. A position control module 224 controls the position of the switching valve 112.

In response to a trigger 228, the purge valve control module 220 transitions the purge valve 106 to the closed position. The purge valve 106 may be biased toward the closed position.

The purge valve 106 may be in the closed position when the trigger 228 is generated and, therefore, may not need to be transitioned to the closed position. In response to the trigger 228, the position control module 224 actuates the switching valve 112 to the pump position. In this manner, the vacuum pump 134 can pump gasses out of the fuel system 100 if the vacuum pump 134 is activated. In response to the trigger 228, the pump control module 218 activates the vacuum pump 134. In response to the trigger 228, a timer module 232 resets and starts incrementing an ON period 236. The ON period 236 tracks the period elapsed since the vacuum pump 134 began pumping gasses out of the sealed fuel system 100.

A triggering module 240 selectively generates the trigger 228 while the vehicle is OFF (key off). For example only, the triggering module 240 may generate the trigger 228 when a period that the vehicle has been OFF is greater than a predetermined period. The predetermined period may be approximately 3-5 hours or another suitable period.

A blockage indication module 244 monitors the second pressure 216. When the trigger 228 is generated, the blockage indication module 244 stores the second pressure 216 as a second initial pressure. The blockage indication module 244 also monitors the ON period 236. When the ON period 236 becomes greater than or equal to a predetermined period, the blockage indication module 244 stores the second pressure 216 as a second final pressure.

The blockage indication module 244 determines a first delta pressure based on a difference between the second initial pressure and the second final pressure. The blockage indication module 244 indicates whether a blockage is present between the second pressure sensor 146 and the fuel tank 102 based on the first delta pressure and a predetermined pressure 248. The blockage indication module 244 may indicate that a blockage is present between the second pressure sensor 146 and the fuel tank 102, for example, when the first delta pressure is greater than the predetermined pressure 248. Conversely, the blockage indication module 244 may indicate that no blockage is present when the first delta pressure is less than the predetermined pressure 248.

The blockage indication module 244 may indicate whether a blockage is present using a blockage indicator 250. For example only, the blockage indication module 244 may set a predetermined code in memory 252 to an active state when a blockage is present and set the predetermined code to an inactive state when a blockage is not present.

A pressure determination module 256 may determine the predetermined pressure 248 based on a fuel level 258 measured using the fuel level sensor 120. The pressure determination module 256 may determine the predetermined pressure 248 using one of a function and a mapping that relates the fuel level 258 to the predetermined pressure 248. For example only, the predetermined pressure may decrease as the fuel level 258 decreases and vice versa. The function or mapping may be generated based on the predetermined period that is compared with the ON period 236. If the function or mapping was not generated based on the predetermined period, the pressure determination module 256 may determine the predetermined pressure 248 further based on the predetermined period. In various implementations, the predetermined pressure 248 may be a fixed value.

When a blockage is present, a location identification module 260 determines a location of the blockage. More specifically, the location identification module 260 determines whether the blockage is located between the fuel tank 102 and the first pressure sensor 142 or between the first pressure sensor 142 and the vacuum pump 134.

When the trigger 228 is generated, the location identification module 260 stores the first pressure 208 as an first initial pressure. When the ON period 236 is later greater than or equal to the predetermined period, the location identification module 260 stores the first pressure 208 as a first final pressure.

The location identification module 260 determines a second delta pressure based on a difference between the first initial pressure and the first final pressure. The location identification module 260 indicates the location of the blockage based on the second delta pressure. The location identification module 260 may indicate that the blockage is located between the first pressure sensor 142 and the fuel tank 102 when the second delta pressure is greater than a second predetermined pressure. When the second delta pressure is less than the second predetermined pressure, the location identification module 260 may indicate that the blockage is located between the first pressure sensor 142 and the vacuum pump 134. For example only, the second predetermined pressure may be approximately 2-3 inches of water or another suitable pressure.

The location identification module 260 may indicate the location of the blockage using a location indicator 264. For example only, the blockage indication module 244 may set a second predetermined code in memory 252 to a first state when the blockage is located between the fuel tank 102 and the first pressure sensor 142. The blockage indication module 244 may set the second predetermined code to a second state when the blockage is located between the first pressure sensor 142 and the vacuum pump 134. The blockage indication module 244 may set the second predetermined code to a third state when a blockage is not present.

A monitoring module 268 may monitor the memory 252 and take one or more remedial actions when a blockage is present. The monitoring module 268 may, for example, activate the indicator lamp 162 and/or take one or more other suitable remedial actions when a blockage is present.

Figure 3:
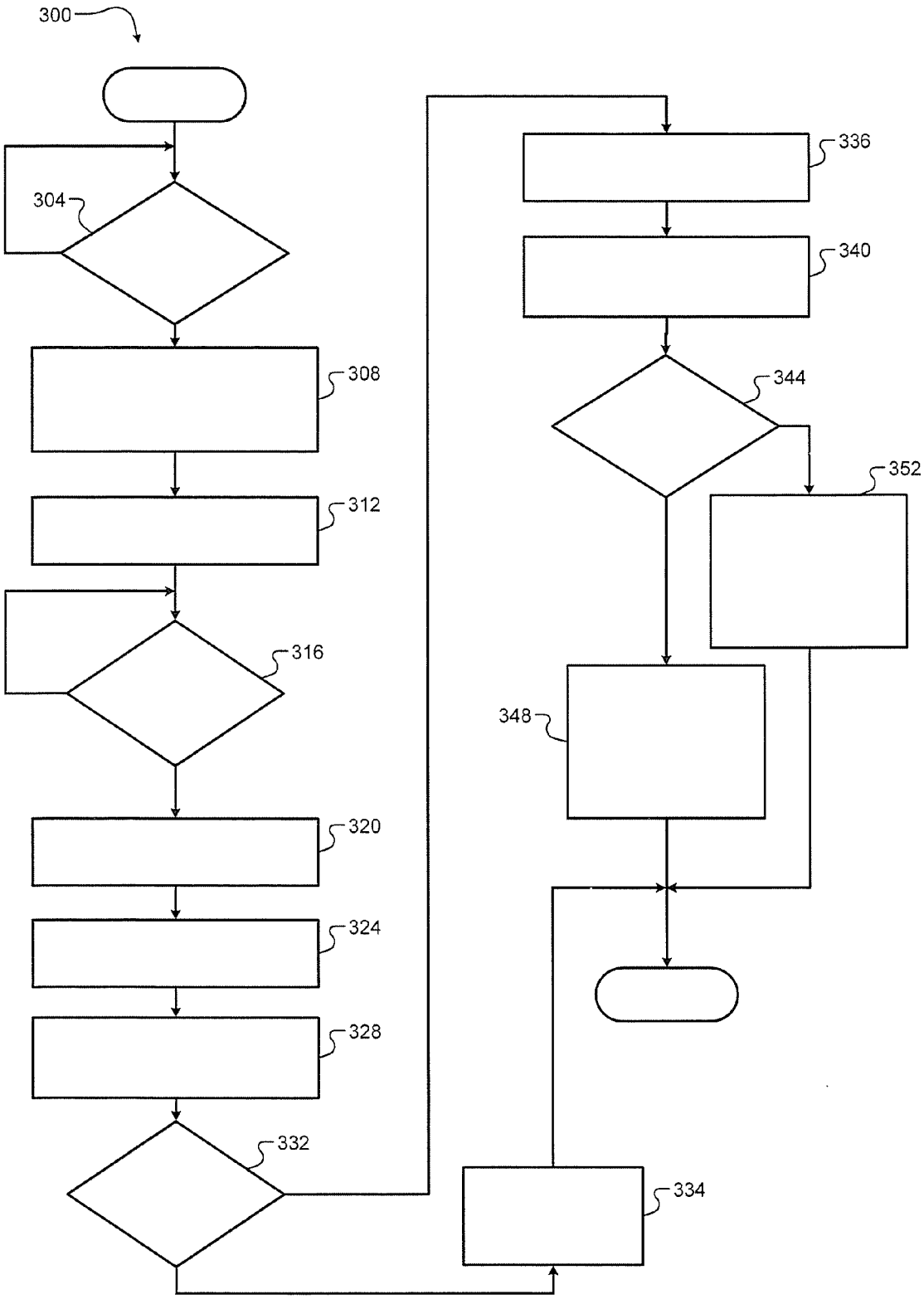
FIG. 3 is a flowchart depicting an example method of detecting a blockage in a fuel system and identifying a location of the blockage according to the present disclosure.

Referring now to FIG. 3, a flowchart depicting an example method 300 of detecting a blockage between the fuel tank 102 and the second pressure sensor 146 and identifying a location of the blockage is presented. Control may begin with 304 where control determines whether one or more triggering conditions are satisfied. If true, control may continue with 308; if false, control may remain at 304. For example only, control may continue with 308 when the period that the vehicle has been off is greater than a predetermined period, such as approximately 3-5 hours.

At 308, control actuates the switching valve 112 to the pump position, closes the purge valve 106 (if not already in the closed position), activates the vacuum pump 134, and resets and starts incrementing the ON period 236. Control stores the first pressure 208 as the first initial pressure and stores the second pressure 216 as the second initial pressure at 312. At 316, control determines whether the ON period 236 is greater than the predetermined period. If true, control proceeds with 320; if false, control may remain at 316.

Control stores the first pressure 208 as the first final pressure and stores the second pressure 216 as the second final pressure at 320. Control determines the predetermined pressure 248 at 324. Control may determine the predetermined pressure 248 based on the fuel level 258. Control determines the first delta pressure based on a difference between the second initial pressure and the second final pressure at 328.

At 332, control determines whether the first delta pressure is greater than the predetermined pressure 248. If false, control may indicate that no blockage is present at 334, and control may end. If true, control may continue with 336.

Control indicates that a blockage is present between the second pressure sensor 146 and the fuel tank 102 at 336. At 340, control may determine the second delta pressure based on a difference between the first initial pressure and the first final pressure.

At 344, control determines whether the second delta pressure is greater than the predetermined pressure. If true, control may indicate that the blockage is located between the fuel tank 102 and the first pressure sensor 142 at 348, and control may end. If false, control may indicate that the blockage is located between the first pressure sensor 142 and vacuum pump 134 at 352, and control may end.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A system for a vehicle, comprising:

a first pressure module that receives a signal from a pressure sensor that measures pressure within a fuel vapor purge system, that generates a first pressure based on the signal at a first time, and that generates a second pressure based on the signal at a second time, wherein the second time is after the first time;

a purge valve control module that maintains a purge valve in a closed position to seal the fuel vapor purge system from the first time until the second time;

a pump control module that operates a vacuum pump from the first time until the second time, wherein the vacuum pump pumps gas out of the fuel vapor purge system when operated; and a blockage indication module that indicates that a blockage is present in the fuel vapor purge system between the pressure sensor and a fuel tank when a difference between the first and second pressures is greater than a predetermined pressure.

2. The system of claim 1 further comprising a pressure determination module that determines the predetermined pressure as a function of an amount of liquid fuel within the fuel tank.

3. The system of claim 2 wherein the pressure determination module determines the predetermined pressure further as a function of the period bounded by the first and second times.

4. The system of claim 1 further comprising:

a second pressure module that receives a second signal from a second pressure sensor that measures a second pressure at a location between the pressure sensor and the fuel tank, that generates a third pressure based on the second signal at the first time, and that generates a fourth pressure based on the second signal at the second time; and a location identification module that, based on the third and fourth pressures and in response to an indication that the blockage is present, indicates that a location of the blockage is one of:

between the pressure sensor and the second pressure sensor; and between the second pressure sensor and the fuel tank.

5. The system of claim 4 wherein the location identification module determines the location based on a second difference between the third and fourth pressures.

6. The system of claim 5 wherein the location identification module indicates that the location is between the pressure sensor and the second pressure sensor when the second difference is greater than a predetermined pressure.

7. The system of claim 5 wherein the location identification module indicates that the location is between the second pressure sensor and the fuel tank when the second difference is less than a predetermined pressure.

8. The system of claim 1 further comprising a monitoring module that activates an indicator lamp in response to an indication that the blockage is present.

9. A method for a vehicle, comprising:

receiving a signal from a pressure sensor that measures pressure within a fuel vapor purge system;

generating a first pressure based on the signal at a first time;

generating a second pressure based on the signal at a second time, wherein the second time is after the first time;

maintaining a purge valve in a closed position to seal the fuel vapor purge system from the first time until the second time;

operating a vacuum pump from the first time until the second time, wherein the vacuum pump pumps gas out of the fuel vapor purge system when operated; and indicating that a blockage is present in the fuel vapor purge system between the pressure sensor and a fuel tank when a difference between the first and second pressures is greater than a predetermined pressure.

10. The method of claim 9 further comprising determining the predetermined pressure as a function of an amount of liquid fuel within the fuel tank.

11. The method of claim 10 further comprising determining the predetermined pressure further as a function of the period bounded by the first and second times.

12. The method of claim 9 further comprising:

receiving a second signal from a second pressure sensor that measures a second pressure at a location between the pressure sensor and the fuel tank;

generating a third pressure based on the second signal at the first time;

generating a fourth pressure based on the second signal at the second time; and, based on the third and fourth pressures and in response to an indication that the blockage is present, indicating that a location of the blockage is one of:

between the pressure sensor and the second pressure sensor; and between the second pressure sensor and the fuel tank.

13. The method of claim 12 further comprising determining the location based on a second difference between the third and fourth pressures.

14. The method of claim 13 further comprising indicating that the location is between the pressure sensor and the second pressure sensor when the second difference is greater than a predetermined pressure.

15. The method of claim 13 further comprising indicating that the location is between the second pressure sensor and the fuel tank when the second difference is less than a predetermined pressure.

16. The method of claim 9 further comprising activating an indicator lamp in response to an indication that the blockage is present.

17. A system for a vehicle, comprising:

a first pressure module that receives a signal from a pressure sensor that measures pressure within a fuel vapor purge system, that generates a first pressure based on the signal at a first time, and that generates a second pressure based on the signal at a second time, wherein the second time is after the first time;

a second pressure module that receives a second signal from a second pressure sensor that measures a second pressure at a location between the pressure sensor and the fuel tank, that generates a third pressure based on the second signal at the first time, and that generates a fourth pressure based on the second signal at the second time;

a purge valve control module that maintains a purge valve in a closed position to seal the fuel vapor purge system from the first time until the second time;

a pump control module that operates a vacuum pump from the first time until the second time, wherein the vacuum pump pumps gas out of the fuel vapor purge system when operated;

a blockage indication module that indicates whether a blockage is present in the fuel vapor purge system between the pressure sensor and a fuel tank based on a difference between the first and second pressures; and a location identification module that, based on the third and fourth pressures and in response to an indication that the blockage is present, indicates that a location of the blockage is one of:

between the pressure sensor and the second pressure sensor; and between the second pressure sensor and the fuel tank.

18. The system of claim 17 wherein the location identification module determines the location based on a second difference between the third and fourth pressures.

19. The system of claim 18 wherein the location identification module indicates that the location is between the pressure sensor and the second pressure sensor when the second difference is greater than a predetermined pressure.

20. The system of claim 18 wherein the location identification module indicates that the location is between the second pressure sensor and the fuel tank when the second difference is less than a predetermined pressure.

21. A method for a vehicle, comprising:

receiving a signal from a pressure sensor that measures pressure within a fuel vapor purge system;

generating a first pressure based on the signal at a first time;

generating a second pressure based on the signal at a second time, wherein the second time is after the first time;

receiving a second signal from a second pressure sensor that measures a second pressure at a location between the pressure sensor and the fuel tank;

generating a third pressure based on the second signal at the first time;

generating a fourth pressure based on the second signal at the second time;

maintaining a purge valve in a closed position to seal the fuel vapor purge system from the first time until the second time;

operating a vacuum pump from the first time until the second time, wherein the vacuum pump pumps gas out of the fuel vapor purge system when operated;

indicating whether a blockage is present in the fuel vapor purge system between the pressure sensor and a fuel tank based on a difference between the first and second pressures; and, based on the third and fourth pressures and in response to an indication that the blockage is present, indicating that a location of the blockage is one of:

between the pressure sensor and the second pressure sensor; and between the second pressure sensor and the fuel tank.

22. The method of claim 21 further comprising determining the location based on a second difference between the third and fourth pressures.

23. The method of claim 22 further comprising indicating that the location is between the pressure sensor and the second pressure sensor when the second difference is greater than a predetermined pressure.

24. The method of claim 22 further comprising indicating that the location is between the second pressure sensor and the fuel tank when the second difference is less than a predetermined pressure.

* * * * *